US005159783A

United States Patent [19]

Rossiter

[11] Patent Number: 5,159,783

[45] Date of Patent: Nov. 3, 1992

[54] END CAP FOR LOUVRE

[75] Inventor: Anthony L. Rossiter, Greenfields, Australia

[73] Assignee: Vergola International Pty. Ltd., Greenfields, Australia

[21] Appl. No.: 797,989

[22] Filed: Nov. 26, 1991

[30] Foreign Application Priority Data

Nov. 28, 1990 [AU] Australia ..... PK3564

[51] Int. Cl.[5] ..... E06B 7/08

[52] U.S. Cl. ..... 49/403

[58] Field of Search ..... 49/403; 160/236

[56] References Cited

U.S. PATENT DOCUMENTS

| | | | |
|---|---|---|---|
| 2,375,176 | 5/1945 | Huff | 49/403 X |
| 2,952,051 | 9/1960 | Scott | 49/403 X |
| 4,019,554 | 4/1977 | Rasmussen . | |
| 4,027,430 | 6/1977 | Sakamoto | 49/403 |
| 4,187,641 | 2/1980 | Thompson . | |
| 4,188,693 | 2/1980 | Edixhoven . | |
| 4,268,995 | 5/1981 | Villa | 49/403 X |
| 4,444,423 | 4/1984 | Montferme et al. . | |

FOREIGN PATENT DOCUMENTS

| | | | |
|---|---|---|---|
| 235941 | 5/1959 | Australia | 49/403 |
| 547724 | 9/1984 | Australia . | |
| 576968 | 7/1986 | Australia . | |

*Primary Examiner*—Philip C. Kannan

*Attorney, Agent, or Firm*—Christie, Parker & Hale

[57] ABSTRACT

This invention relates to an end cap for use with a hollow sheet metal louvre wherein the end cap 10 comprises an end wall 12, a shaft 16 on one side of the end wall for pivotal mounting of the end cap 10, upper and lower flanges 13 and 14 that extend along the upper and lower edges of the end wall 12 which in use extend over the upper and lower surfaces of the louvre 11, and resilient deformable gripping member 20 mounted between the upper and lower flanges 13 and 14 which in use allows the end cap 10 to be pushed onto the louvre 11 where the gripping member, which is located within the hollow louvre, bears against the sheet metal so as to hold the louvre 11 between the gripping member 20 and each upper and lower flange 13 and 14. In addition, the invention provides novel means for side by side stacking of assembled louvres, and a novel means is provided which allows the shaft 16 to engage a bracket 17 while at the same time preventing disengagement of the shaft in the normal operating position.

10 Claims, 2 Drawing Sheets

END CAP FOR LOUVRE

This invention relates to an improved louvre end cap design, and in particular to an improved louvre end cap for use with hollow louvres formed from a pair of roll formed sheet metal sections.

In previous Australian patent applications numbered 60674/86 and 33573/84, the present applicant has described both an adjustable louvre roof and a machine for forming louvres via forming rollers. Both inventions describe a hollow louvre formed from two sheet metal strips which have the edge crimped in a manner such as to form a hollow louvre with an elliptical cross section. Each of the longitudinal edges are formed so as to engage with adjacent louvres to provide weatherproof seal when in the closed position.

As shown in Australian patent number 33573/84, each of the individual louvres are provided with a plastic end cap. The end cap is secured to the louvres by rivets, and in the assembly process, it is necessary to drill at least two holes on either side of the louvre and install the rivets so as to positively hold the end cap to the louvres.

Obviously, such an assembly process is extremely time consuming, and has other deleterious effects such as producing sites for corrosion and the unsightly appearance of rivet heads being visible on the end cap. In addition, there is a problem with swarf within the louvre blade, and through incorrect positioning of the end cap, the louvre may jam during movement.

Therefore, it is an object of one aspect of this invention to provide an end cap which is quickly and easily fitted to the end of a louvre.

It is a further object to provide a secure means of fixing the end cap to a louvre, such that the end cap will remain securely in position under normal operating conditions.

Therefore, in one aspect of the invention, an end cap for a hollow sheet metal louvre comprises an end wall which substantially extends across an end of a louvre, a shaft on one side of the end wall, extending away from the louvre, for pivotal mounting of the end cap, upper and lower flanges extending along the upper and lower edge of the end wall, that in use, extend over the upper and lower surfaces of the louvre end, and at least one resiliently deformable gripping member mounted between the upper and lower flanges which in use allows the end cap to be pushed onto the louvre, where the gripping member which is located within the hollow louvre, bears against the sheet metal so as to hold the louvre between the gripping member and each upper and lower flange.

Preferably, the gripping member comprises a plate which extends between the upper and lower flanges. The plate may be mounted on a spigot which extends from the end wall, and to enhance the gripping force, the plate may be curved such that the ends of the plate extend inwardly towards the end wall. Further, the plate may have serrated ends to also assist in gripping the louvre.

The clearance between the ends of the plate and respective upper and lower flanges is preferably minimal such that the insertion of the sheet metal portion of the louvre causes deformation of the plate, which results in the plate exerting force against the sheet metal of the louvre. This force together with any curvature of the gripping member provides ample securing force for the end cap.

In order to assist in the assembly of the end cap to the louvre, either the upper or lower flange of the end cap is wider than the other flange, and the narrower flange is provided with a chamfered edge such that upon assembly, the wider flange locates the end cap on the louvre, and the chamfered edge on the narrow flange allows the end cap to be easily located onto the louvre.

A further difficulty with the invention as described in the earlier patent applications is that a major portion of the rigidity of each louvre is created by the glue which is inserted between the rolled joints at the time of manufacture. After each louvre has been roll-formed, it is essential that the louvre be held firmly with each end cap aligned so as to prevent the louvre forming a warp or twist when drying.

A special rack has been used having end rails with notches therein for location of the louvre. The notches were shaped so as to hold the louvre and the end cap in end to end alignment. In order to help save time, these racks were also used to transport a batch of louvres. Therefore, an upper rack was provided which located on top of the louvres, and strapping was applied so that the racks could be transported as a unit.

A problem with the rack system was the inordinate cost of producing the required number of racks. Obviously, a large proportion of the racks spent their time in the field before being returned to the manufacturing site, and production of the louvres was limited to the availability of these racks at the production site.

Therefore, there is a need, and it is an object of a further aspect of this invention, to provide a means whereby the above problems can be overcome.

Therefore, in this aspect of the invention, each end cap further comprises at least two projections on one edge of the end wall each having a recess therein and at least two projections on the other edge of the end wall having spigots thereon which are locatable within said recesses of an adjacent end cap as the end caps are brought together such that assembled louvres can be stacked side by side, said end caps further having planar ends which allow the end caps to stand vertically on a horizontal surface, such that stacked louvres can be supported on the ends of the end caps.

Preferably, the spigots are of circular cross section, and the corresponding recesses have a circular section for location of the spigots. In addition, the projections may have overlapping portions which prevent the assembled louvres from moving longitudinally when adjacent end caps are brought together.

The upper and lower flanges of the end cap may be curved so as to conform with the elliptical cross-section of the louvres, each of the assembled louvres could not be stacked one on top of the other. The abovedescribed invention provides projections on each side of the end cap which have either recesses or projections for engagement with adjacent end caps, so that a number of louvres can be assembled together. Such an arrangement ensures that each louvre is held in an aligned position as the glue dries.

The planar ends of each end cap enable the assembled louvres to be stacked on their edges.

Preferably, a pair of batons or rails spaced such that the end cap of each louvre can be seated on the baton. The planar ends of each end cap will ensure that no twisting or warping or the louvre occurs. Preferably, each end cap is provided with the engaging projections, and therefore further assembled louvres can be located adjacent one another, and by placing a further baton across the top of each end cap, and applying strapping thereto, the batch of louvres can be held in position for drying of the glue, so as to produce warp-free louvres. The bound louvres are more easily transported when held in this manner.

As shown in the previously mentioned Australian patent applications, each end cap is provided with a shaft which enables the louvre to locate within recesses for the pivotal movement of each louvre. Presently, the shaft comprises a discoid head at the end which locates within a bracket having a slot which accepts the shaft. The head on the end of the shaft holds the louvre in place under most normal operating forces. However, in order to prevent upward movement of the shaft, which may occur under certain wind conditions, it is necessary to provide some means of securing the shaft within the bracket.

Therefore, it is a further object of this invention to provide a bracket incorporating restraining means which prevents dislodgement of the shaft.

According to this aspect of the invention, said shaft is rotatably engageable in a bracket, said bracket having a slot on one edge to receive the shaft, said slot having a tab extending part way across the slot and said shaft having a recess within which the tab is locatable so as to allow the shaft to pass into the slot, the opening of the slot being reduced by the tab so that it is smaller than the diameter of the shaft.

Preferably, the bearing slots in the brackets are formed in a continuous length of material having the correct spacing between slots, which in turn will assist in rapid on-site assembly.

So that the invention may be readily understood, a preferred embodiment will now be described, but it should be realised that the scope of this invention is not to be restricted to the details shown in this embodiment.

This embodiment is illustrated in the accompanying drawings in which.

Figure 6:
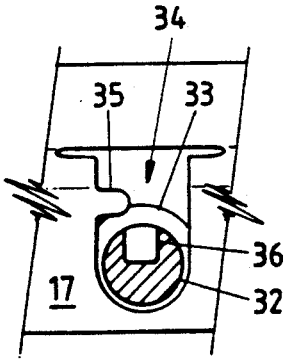
Figure 5A:
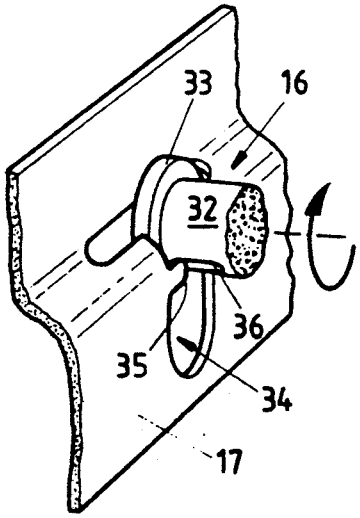
Figure 5B:
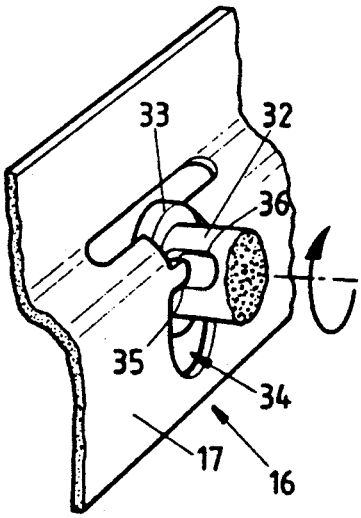
Figure 5C:
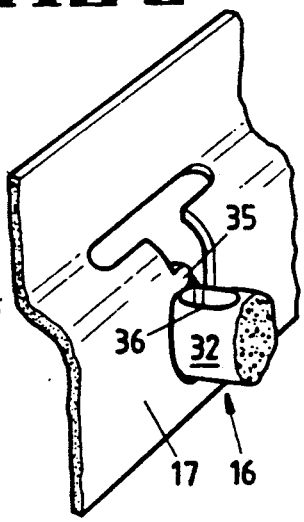

FIGS. 5*a*, 5*b* and 5*c* show the end cap shaft, the bracket within shaft locates and means by which the shaft locates into the bracket; and FIG. 6 shows a cross sectional view of the shaft located within the bracket.

Figure 1:
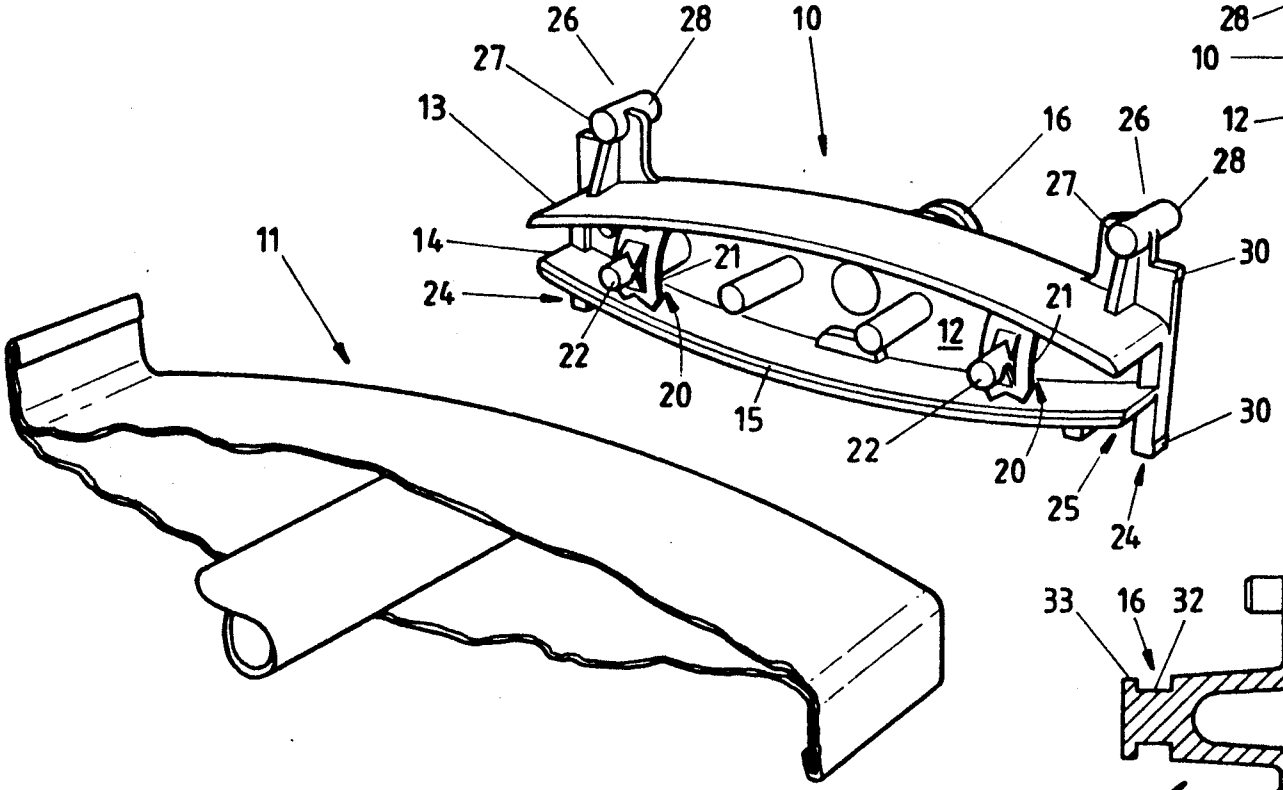
FIG. 1 shows an exploded view of an end cap and an end of a louvre.
Figure 4:
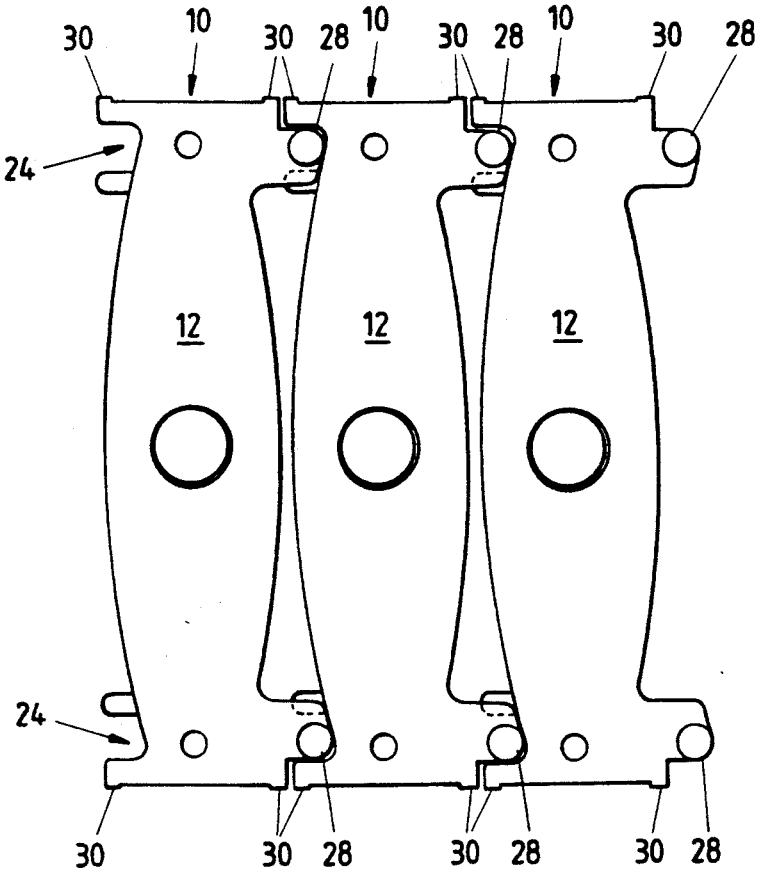
FIG. 4 shows a number of end caps fitted together.

As can be seen in FIG. 1, the end cap 10 for attachment to the end of a louvre 11 comprises an end wall 12 and an upper and lower flange 13 and 14 wherein the upper and lower flange 13 and 14 have an arcuate shape so as to conform to the elliptical cross section of the louvre 11. The end cap 10 is also provided with a shaft 16 which allows the assembled louvre to be supported between brackets 17 for pivoting of the louvre blade 11.

In order to secure the end cap 10 to the upper and lower sheet metal sections forming the louvre blade 11, there is provided a pair of gripping members 20 which comprise a curved spring steel plate 21. The plates 20 are secured to the end cap 10 by spigots 22 which extend from the end wall 12, and in this embodiment, the plates 21 have speed-nut style apertures for securing the plate 21 to the spigot 22. The clearance between the ends of the plates 21 and the upper and lower flanges 13 and !4 is minimal such that when the sheet metal section of the louvre is inserted, each plate 21 flexes, thereby providing a positive bearing force against the sheet metal section. When the upper and lower sheet metal sections are fully located within the end cap 10, any attempt to withdraw the end cap 10 from the end of the louvre 11 will cause the plate 21 to straighten thereby increasing the compressive force between the gripping member 20 and the upper and lower flanges 13 and 14.

As can be seen, this provides an effective means of quickly locating the end cap 10 on a louvre 11, while at the same time providing sufficient restraining force to securely locate the end cap 10 on the louvre 11.

Figure 2:
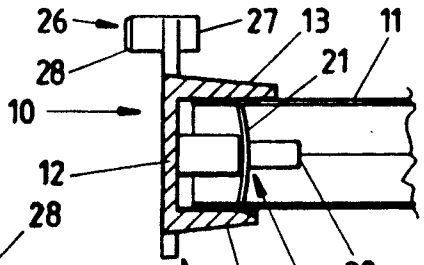
FIG. 2 shows a cross sectional view of an end cap attached to the end of a louvre adjacent to a resilient gripping means.
Figure 3:
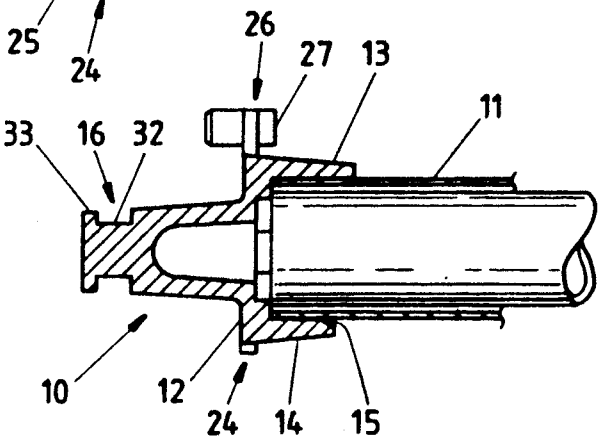
FIG. 3 shows a cross section of an end cap fitted to a louvre where the cross section is through the centre of the end cap.

As can be seen in FIGS. 2 and 3, the upper flange 13 is wider than the lower flange 14. In addition, the lower flange 14 is provided with a chamfered edge 15 such that upon initial fitting of the end cap 10, the louvre 11 is located underneath the upper flange 13, which assists in aligning the end cap 10 with the louvre 11, whereupon the chamfered edge 15 on the lower flange 14 guides the louvre 11 within the lower flange 14 as the end cap 10 is pushed onto the louvre 11.

In a further aspect of this invention, there are provided first projections 24 having recesses 25, and second projections 26 having spigots 27. One end of the spigot 27 locates within the recess 25. This enables assembled louvres 11 to be stacked or aligned together, and the interengagement of the adjacent spigot 27 and recesses 25 prevents movement of louvres transverse to the longitudinal axis of each louvres. The other end of the spigot 28 is used to connect each end cap 10 to a control rod (not drawn) which, when moved back and forth, rotate each louvre 11 open or closed.

In order to prevent or restrain movement of stacked louvres in the longitudinal direction, the projections 24 and 26 overlap.

This prevents any relative longitudinal movement between adjacent louvres 11.

A further feature to assist in the stacking of assembled louvres 11 is the provision of planar end portions 30. The end portions 30 provide a planar surface to enable the assembled louvres to be stored on edge. A baton (not drawn) may be used to support the assembled louvres, and a further pair of batons can be placed along the top of the end caps 10. Binding strips are then used to secure the bundle together. With such an assembly, a batch of assembled louvres can be readily transported without fear of warping or damage to the louvres. In addition, transport costs are reduced.

In a final aspect of this invention, the shaft 16 of each end cap 10 is provided with a bearing surface 32 and a head 33 for pivotal location in a supporting bracket 17. The supporting bracket 17, which in this embodiment is produced in a continuous length, has a series of slots 34 formed therein for location of the shaft 16. Extending part way across each slot 34 is a tab 35 which restrains the shaft 16 within the slot 34. In order to locate the shaft 16 within the slot 34, a recess 36 is provided in the bearing surface 32 into which the tab 35 locates, thereby allowing the shaft 16 to pass into the slot 34. In the normal operating position, the recess 36 is positioned so that it is not positioned adjacent the tab 35, thereby preventing accidental disengagement.

The head 33 at the end of the bearing surface 32 restrains the shaft 16 against lateral movement. Sufficient clearance is provided, such that should there be any movement of the structure to which the supporting bracket is secured, the louvres 11 will be prevented from jamming.

As can be seen from the above description, the invention provides a novel end cap for use in relation to roll-formed louvres. In addition to providing advantages in respect of assembly of the louvre and end cap, it provides significant advantages in on-site assembly of the louvre system.

The claims defining the invention are as follows:

1. An end cap for fitment to a hollow sheet metal louvre comprising an end wall which substantially extends across an end of a louvre, a shaft on one side of the end wall, extending away from the louvre, for pivotal mounting of the end cap, upper and lower flanges extending along the upper and lower edge of the end wall, and arranged, when the end cap is fitted to the louvre, to extend over the upper and lower surfaces of the louvre end, and at least one resiliently deformable gripping member mounted between the upper and lower flanges which in use allows the end cap to be pushed onto the louvre, with the gripping member located interiorly thereof and being arranged to bear against the louvre sheet metal so as to hold the louvre between the gripping member and each upper and lower flange.

2 An end cap according to claim 1 wherein the gripping member comprises a plate extending between the upper and lower flanges.

3. An end cap according to claim 2 wherein the plate is curved such that the ends extend inwardly toward the end wall.

4. An end cap according to either claim 2 or claim 3 further comprising a spigot on the end wall, said plate being mounted on the spigot.

5. An end cap according to either claim 2 or claim 3 wherein the plate has serrated ends.

6. An end cap according to claim 1 or claim 2 wherein one flange is wider than the other flange, and the narrower flange has a chamfered outer edge.

7. An end cap according to claim 1 or claim 2 further comprising at least two projections on one edge of the end wall each having a recess therein and at least two projections on the other edge of the end wall having spigots thereon which are locatable within said recesses of an adjacent end cap as the end caps are brought together such that assembled louvres can be stacked side by side, said end caps further having planar ends which allow the end caps to stand vertically on a horizontal surface, such that stacked louvres can be supported on the ends of the end caps.

8. An end cap according to claim 7 wherein said projections overlap thereby preventing longitudinal movement of adjacent louvres.

9. An end cap according to claim 1 wherein said shaft is rotatably engageable in a bracket, said bracket having a slot on one edge to receive the shaft, said slot having a tab extending part way across the slot and said shaft having a recess within which the tab is locatable so as to allow the shaft to pass into the slot, the opening of the slot being reduced by the tab so that it is smaller than the diameter of the shaft.

10. An end cap according to claim 9 wherein the recess in the shaft is positioned such that in the normal operating range of shaft rotation, the recess does not pass the slot opening.

* * * * *

UNITED STATES PATENT AND TRADEMARK OFFICE

CERTIFICATE OF CORRECTION

PATENT NO. :5,159,783

DATED :November 3, 1992

INVENTOR(S) :Anthony L. Rossiter

It is certified that error appears in the above-identified patent and that said Letters Patent is hereby corrected as shown below:

Column 3, line 51, after "within" insert -- which the --.

Column 4, line 4, change "!4" to -- 14 --.

Signed and Sealed this

Ninth Day of November, 1993

Bruce Lehman

*Attest:*

BRUCE LEHMAN

*Attesting Officer*

*Commissioner of Patents and Trademarks*